United States Patent [19]

Knapp et al.

[11] 3,999,528

[45] Dec. 28, 1976

[54] DIAPHRAGM VALVE

[75] Inventors: Heinrich Knapp, Leonberg-Silberberg; Siegfried Setter, Stuttgart-Zuffenhausen, both of Germany

[73] Assignee: Robert Bosch G.m.b.H., Stuttgart, Germany

[22] Filed: July 18, 1975

[21] Appl. No.: 597,153

[30] Foreign Application Priority Data

Aug. 27, 1974 Germany ..... 2441048

[52] U.S. Cl. ..... 123/139 AW; 137/469; 137/510; 251/61.1

[51] Int. Cl.[2] ..... F02M 69/00; F16K 31/12; F16K 31/165

[58] Field of Search ..... 123/139 AW, 119 R; 137/469, 510; 261/61.1

[56] References Cited

UNITED STATES PATENTS

| | | | |
|---|---|---|---|
| 2,361,084 | 10/1944 | Canetta | 137/469 X |
| 2,387,792 | 10/1945 | Holmes | 137/469 X |
| 2,603,231 | 7/1952 | Birkemeier | 137/510 X |
| 3,942,497 | 3/1976 | Schwartz | 123/139 AW |

FOREIGN PATENTS OR APPLICATIONS

| | | | |
|---|---|---|---|
| 2,006,305 | 8/1971 | Germany | 123/139 AW |
| 1,231,967 | 5/1971 | United Kingdom | 123/139 AL |

*Primary Examiner*—Charles J. Myhre
*Assistant Examiner*—Tony M. Argenbright
*Attorney, Agent, or Firm*—Edwin E. Greigg

[57] ABSTRACT

A diaphragm valve which may serve as an equal pressure valve or as a pressure equalizing valve of a fuel metering and distributing unit for an externally ignited internal combustion engine. The valve has a flexible diaphragm having a clamped diameter and to which a valve plate is connected. The valve plate operatively cooperates with a valve seat of the valve and has a diameter which is as large as possible in relation to the clamped diameter of the diaphragm. The valve also includes a stationary thrust plate which is concentrically disposed relative to the valve seat, which defines a knife-shaped edge which lies in a common plane with the valve seat and which operatively cooperates with the valve plate. The knife-shaped edge has a diameter which is as large as possible in relation to the diameter of the valve plate.

7 Claims, 2 Drawing Figures

DIAPHRAGM VALVE

CROSS REFERENCE TO RELATED APPLICATIONS

The present application discloses subject matter in common with applications Ser. No. 518,988 now U.S. Pat. No. 3,942,497, filed on Oct. 19, 1974 by Reinhard Schwartz, and Ser. No. 597,912 filed on July 21, 1975 by Gerhard Stumpp. These applications are assigned to the same assignee.

BACKGROUND OF THE INVENTION

The present invention relates to a diaphragm valve comprising as the movable valve part a flexible diaphragm, and more particularly, a plastic diaphragm, separating two chambers through which pressurized liquid flows.

Diaphragm valves of this type are already used in fuel injection systems in which the influence of temperature variations on the metered quantity of injection fuel is eliminated by means of diaphragms consisting of webbing like membranes. However, these membranes are subject to the disadvantage that the flexible membrane oscillates and effects undefined opening and closing movements about the valve seat, resulting in unwanted variations in the metered quantity of injection fuel.

OBJECTS AND SUMMARY OF THE INVENTION

It is, therefore, an object of the present invention to provide the existing state-of-the-art with an improved diaphragm valve of the type discussed above.

It is another object of the present invention to provide the existing state-of-the-art with a diaphragm valve of the type discussed above which fulfills the requirements of this type of valve and which ensures that the pressure of the pressurized liquid flowing through the system is controlled as accurately as possible in spite of the fact that a flexible membrane is employed.

These and other objects of the present invention are achieved by the provision of a valve plate, which is connected with the diaphragm and which cooperates with a valve seat, having a diameter which is as large as possible in relation to the clamping diameter of the diaphragm, more particularly approximately 4/5 of the clamping diameter; and by the provision of a stationary thrust ring concentrically disposed with respect to the valve seat, a knife-shaped front side of which is disposed in the same plane as the valve seat and has as large a diameter as possible which cooperates with the valve plate.

According to an advantageous feature of the present invention, the front side of the thrust ring is interrupted by transverse grooves.

Another advantageous feature of the present invention consists in that the diaphragm valve is in the form of a pressure-equalizing valve of a fuel metering and distributing unit.

A further advantageous feature of the present invention consists in that the diaphragm valve is in the form of a differential pressure valve of a fuel metering and distributing unit.

Other objects, features and advantages of the present invention will be made apparent in the following detailed description of a preferred embodiment thereof provided with reference to the accompanying drawings.

DESCRIPTION OF THE PREFERRED EMBODIMENT

Figure 1:
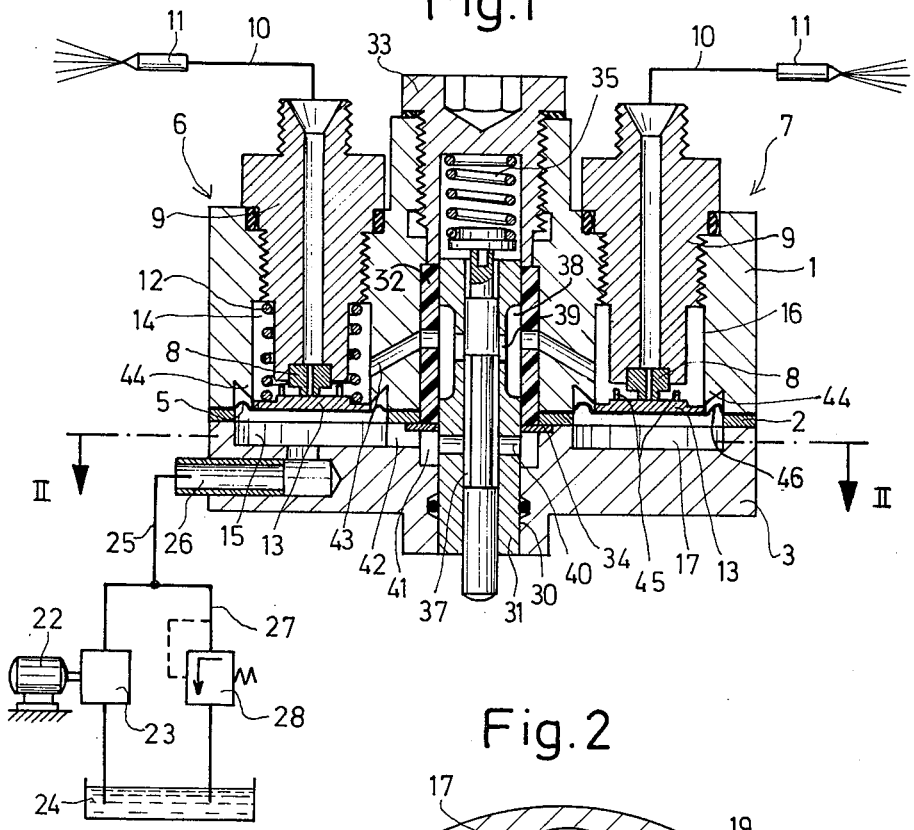
FIG. 1 is an axial sectional view of an exemplary embodiment of a fuel injection system which includes a diaphragm valve according to the present invention.
Figure 2:
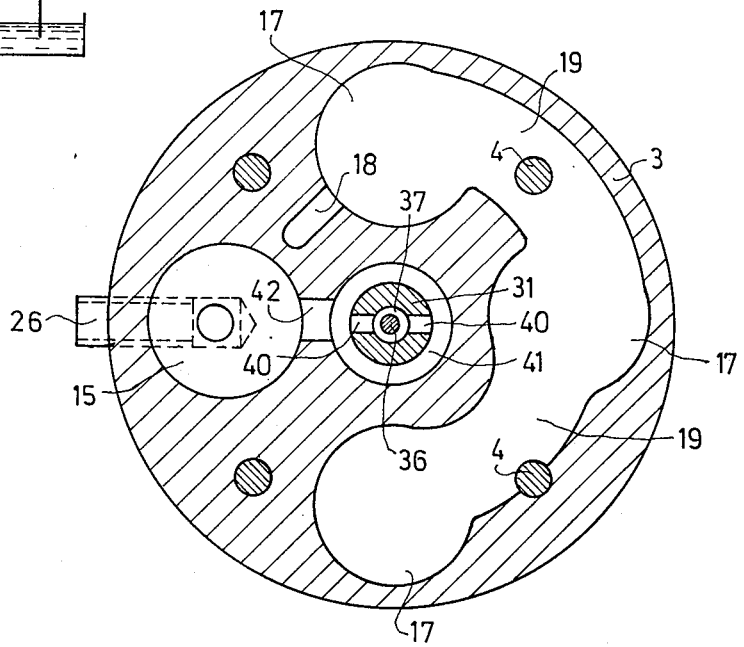
FIG. 2 is a cross-sectional view along the line II—II of FIG. 1.

The exemplary embodiment of the diaphragm valve is included in a fuel injection system as illustrated in FIGS. 1 and 2 for a four-cylinder internal combustion engine. The system includes a fuel metering and distributing unit having a housing 1, an intermediate plate 2 and a bottom cover 3 axially clamped together by means of bolts 4. Clamped between the housing 1 and the intermediate plate 2 is a flexible diaphragm 5 which serves to divide axial bores 14, 15 and 16, 17, uniformly distributed about the longitudinal axis of the housing, into chambers 14, 15 and 16, 17. The diaphragm 5 also serves as the diaphragm for diaphragm valves 6 and 7. Because the exemplary embodiment illustrated relates to a fuel metering and distributing unit for a four-cylinder internal combustion engine, there are four diaphragm valves, of which one is a differential pressure control valve 6 and the other three valves are pressure equalizing valves 7. In each of these valves, the diaphragm 5 forms a flat seat valve with a stationary valve seat 8. The valve seat 8 is mounted to valve seat carrier 9 which is threadedly engaged with the housing 1 and which serves as the connecting member for conduits 10 leading to the injection valves 11. A helical spring 12 having as flat a spring characteristic as possible is supported on the valve seat carrier 9 of the differential pressure valve 6. The helical spring 12 biases the diaphragm 5 in the opening direction via a valve plate 13 which is in the form of a spring rest and which is connected to the diaphragm 5. Thus, the differential pressure control valve 6 is open when inoperative. On the one hand, the diaphragm 5 serves firstly to divide a first chamber 14 from a second chamber 15 of the differential pressure control valve 6 and, on the other hand, to divide the first chamber 16 from the second chamber 17 of the pressure equalizing valves 7. A channel 18 leads from the first chamber 14 of the differential pressure control valve 6 to the second chamber 17 of a pressure equalizing valve 7. The second chambers 17 of the pressure equalizing valve 7 are interconnected by means of an annular channel 19.

Fuel is supplied from a fuel tank 24 by means of a pump 23 driven by an electric motor 22. The fuel passes through a conduit 25 and a connecting member 26 into the second chamber 15 of the differential pressure control valve 6. From the conduit 25 there extends a conduit 27, in which a pressure limiting valve 28 is disposed. When there is excessive pressure in the system the pressure limiting valve 28 allows fuel to flow back into the fuel tank 24.

An axial bore 30 formed in the housing 1, the intermediate plate 2 and the bottom cover 3 of the fuel distributing unit has a bushing 31 mounted therein. The bushing 31 is prevented from being axially displaced and rotated by means of an elastic sealing sleeve 32 which may be made of rubber. To achieve this the sealing sleeve is axially compressed by a plug 33 against a disk 34 disposed between the bottom cover 3 and the intermediate plate 2. This measure also prevents any fuel from leaking between the bushing 31 and the housing 1 and the intermediate plate 1.

A control slide 36 into which an annular groove 37 is formed is axially slidable against the force of a spring 35 in the bushing 31. In place of the spring 35, the restoring force exerted on the control slide 36 could also be produced by pressurized fluid controlled by a hydraulic pressure control system (not shown) exerting a force on the slide.

Longitudinal grooves 38 which communicate with the inner bore of the bushing 31 through exactly identical, axially parallel, longitudinal slots 39 (control slots) are located in the bushing 31. Thus, depending on the position of the control slide 36, the annular groove 37 opens or uncovers a section of the control slots 39 of greater or lesser length. Radial bores 40 which provide constant communication between the annular groove 37 and an annular channel 41 provided in the bottom cover 3 are also provided in the bushing 31. The annular channel 41 communicates with the second chamber 15 of the differential pressure control valve 6 by means of a channel 42. The longitudinal grooves 38 of the bushing 31 communicate with the first chamber 14 of the differential pressure control valve 6 of the first chambers 16 of the pressure equalizing valves 7 by means of bores 43. A longitudinal groove 38 and an associated control slot 39 are provided for each of the valves 6 and 7. The first chambers 14 or 16 are thereby separated from one another.

According to the present invention, fixed thrust rings 44 are concentrically disposed with respect to the valve seats 8. The knife-shaped front sides of these thrust rings are disposed generally in the same plane as the valve seats 8. The diameter of the knife-shaped front side of each thrust ring 44 is generally of uniform size, but is smaller than the diameter of the valve plate 13. The diameter of the valve plate 13 is as large as possible in relation to the clamping diameter of the diaphragm 5, and, in particular, it corresponds to approximately ⅔ to 4/5 of the clamping diameter. The front sides of the thrust rings 44 are interrupted by transverse grooves 45 which permit pressure equalization in the first chambers 14 or 16 when the valve plate 13 rests against the thrust ring 44.

The method of operation of the fuel injection system described is as follows:

The fuel supplied by the fuel pump 23 is delivered via the conduit 25 and the connecting member 26 to the second chamber 15 of the differential pressure control valve 6. From there it flows via the channel 42, the annular channel 41 and the radial bore 40 into the annular groove 37 of the control slide 36. The control slide 36 can be displaced in an axial direction, for example, by means of an air sensing element (not shown) disposed in the suction tube of the internal combustion engine, such that the annular groove 37 opens the control slots 39 to a greater or lesser extent. The fuel is metered by the control slots 39 and flows from the annular groove 37 into the longitudinal grooves 38. From there it flows through the bores 43 into the first chamber 14 of the differential pressure valve 6, and the first chambers 16 of the pressure equalizing valves 7. The first chamber 14 of the differential pressure control valve 6 communicates via the channel 18 with the second chambers 17 of the pressure equalizing valves which communicate with one another via the annular channel 19.

The force of the spring 12 of the differential pressure control valve 6 is such that when there is a variation in the pressure drop between the first chamber 14 and the second chamber 15, the flow passage cross section between the diaphragm 5 and the valve seat 8 is varied until this pressure drop is once again restored. In the case of the flat seat valve which is illustrated, this can be achieved in a very short time as the flow passage cross section changes considerably even when there is only minimal lifting of the diaphragm. On the other hand, the spring force is only minimally varied as a result of this minimal lifting action and thus the control system can operate extremely accurately. In other words, the pressure drop is virtually constant irrespective of the fuel quantities flowing through the system.

The throttling action on the fuel at the control slots 39 is approximately uniform and thus the fuel pressure is approximately uniform. Thus the fuel pressure in the first chamber 14 of the differential pressure control valve 6 and the first chambers 16 of the pressure equalizing valves 7 is approximately uniform. By virtue of the fact that the first chamber 14 of the differential pressure control valve 6 communicates with the second chambers 17 of the pressure equalizing valves 7, in the regulated state, the fuel pressure in the second chambers 17 is generally equal to that in the first chambers 16. The use of pressure equalizing valves offers the advantage that to obtain the desired pressure difference at the metering valves 37, 39, it is only necessary to adjust the spring 12 of the differential pressure control valve 6. There is no need to adjust the individual pressure equalizing valves 7.

The portion of the diaphragm 5 associated with each of the valves 6 and 7 comprises a reinforcing bead 46 near its clamped periphery. In this way the diaphragm operates in a flexible manner but does not exert force on the valve. In the operating state the valve plate 13 of the diaphragm 5 will rest on any place on the front side of the thrust ring 44. This place acts as a hinge permitting the friction-free mobility of the diaphragm with respect to the valve seat 8, while avoiding oscillation of the diaphragm.

The diaphragm valves according to the present invention comprising a supporting ring have the advantage that defined opening and closing movements can be obtained even in the case of diaphragm valves comprising flexible diaphragms, thus making it possible to obtain control capable of satisfying high requirements.

What is claimed is:

1. In a diaphragm valve including: means defining a chamber; a flexible diaphragm forming a movable part of the valve, said diaphragm being clamped by the chamber defining means so as to extend across the chamber and divide same into two chambers through which pressurized liquid flows; and a valve seat positioned in one of the chambers in operative proximity to the diaphragm, the improvement comprising:

a. a valve plate connected to the diaphragm and serving to operatively cooperate with the valve seat; and b. a stationary thrust ring concentrically disposed with respect to the valve seat and defining a knife-shaped edge which lies in a common plane with the valve seat and which operatively cooperates with the valve plate, wherein:

i. the diameter of the valve plate is as large as possible in relation to the clamped diameter of the diaphragm; and ii. the diameter of the knife-shaped edge is less than the diameter of the valve seat and as large as possible in relation to the diameter of the valve plate.

2. The diaphragm valve as defined in claim 1, wherein the diameter of the valve plate is between ⅔ and 4/5 of the clamped diameter of the diaphragm.

3. The diaphragm valve as defined in claim 1, wherein the diameter of the valve plate is approximately 4/5 of the clamped diameter of the diaphragm.

4. The diaphragm valve as defined in claim 1, wherein the thrust ring includes spaced transverse grooves which interrupt the continuity of the knife-edge.

5. The diaphragm valve as defined in claim 1, wherein the diaphragm includes a reinforcing bead near its clamped periphery, said reinforcing bead serving to permit the diaphragm to operate in a flexible manner while exerting substantially no force on the valve.

6. In a fuel metering and distributing unit for an externally ignited internal combustion engine, including: a plurality of fuel metering valves; and an equal plurality of pressure valves, at least one of which serves as a pressure equalizing valve comprising:

a. means defining a chamber;

b. a flexible diaphragm forming a movable part of the valve, said diaphragm being clamped by the chamber defining means so as to extend across the chamber and divide same into two chambers through which pressurized liquid flows:

c. a valve seat positioned in one of the chambers in operative proximity to the diaphragm;

d. a valve plate connected to the diaphragm and serving to operatively cooperate with the valve seat; and e. a stationary thrust ring concentrically disposed with respect to the valve seat and defining a knife-shaped edge which lies in a common plane with the valve seat and which operatively cooperates with the valve plate, wherein:

i. the diameter of the valve plate is as large as possible in relation to the clamped diameter of the diaphragm; and ii. the diameter of the knife-shaped edge is less than the diameter of the valve seat and as large as possible in relation to the diameter of the valve plate.

7. In a fuel metering and distributing unit for an externally ignited internal combustion engine, including: a plurality of fuel metering valves; and an equal plurality of pressure valves, at least one of which serves as an equal pressure valve comprising:

a. means defining a chamber;

b. a flexible diaphragm forming a movable part of the valve; said diaphragm being clamped by the chamber defining means so as to extend across the chamber and divide same into two chambers through which pressurized liquid flows;

c. a valve seat positioned in one of the chambers in operative proximity to the diaphragm;

d. a valve plate connected to the diaphragm and serving to operatively cooperate with the valve seat; and e. a stationary thrust ring concentrically disposed with respect to the valve seat and defining a knife-shaped edge which lies in a common plane with the valve seat and which operatively cooperates with the valve plate, wherein:

i. the diameter of the valve plate is as large as possible in relation to the clamped diameter of the diaphragm; and ii. the diameter of the knife-shaped edge is less than the diameter of the valve seat and as large as possible in relation to the diameter of the valve plate.

* * * * *